US010077411B2

(12) United States Patent
Yoshinari et al.

(10) Patent No.: US 10,077,411 B2
(45) Date of Patent: Sep. 18, 2018

(54) GREASE COMPOSITION

(71) Applicants: KYODO YUSHI CO., LTD., Fujisawa-shi, Kanagawa (JP); DENSO CORPORATION, Kariya-shi, Aichi (JP)

(72) Inventors: Terasu Yoshinari, Chigasaki (JP); Tomonobu Komoriya, Toyota (JP); Iwaki Hirooka, Fujisawa (JP); Masataka Muto, Kariya (JP); Satoru Nakazawa, Kariya (JP); Yoshinori Fukushima, Kariya (JP); Shigeyuki Mori, Morioka (JP)

(73) Assignees: KYODO YUSHI CO., LTD., Fujisawa-Shi, Kanagawa (JP); DENSO CORPORATION, Kariya-Shi, Aichi (JP)

( * ) Notice: Subject to any disclaimer, the term of this patent is extended or adjusted under 35 U.S.C. 154(b) by 0 days.

(21) Appl. No.: 14/909,377

(22) PCT Filed: Aug. 4, 2014

(86) PCT No.: PCT/JP2014/070467
§ 371 (c)(1),
(2) Date: Feb. 1, 2016

(87) PCT Pub. No.: WO2015/016376
PCT Pub. Date: Feb. 5, 2015

(65) Prior Publication Data

US 2016/0177213 A1 Jun. 23, 2016

(30) Foreign Application Priority Data

Aug. 2, 2013 (JP) ..... 2013-161383

(51) Int. Cl.
*C10M 135/36* (2006.01)
*A01N 29/04* (2006.01)
(Continued)

(52) U.S. Cl.
CPC ..... *C10M 135/36* (2013.01); *C10M 101/02* (2013.01); *C10M 105/04* (2013.01);
(Continued)

(58) Field of Classification Search
CPC ..... C10M 2219/104; C10M 2219/00; C10M 2215/102
(Continued)

(56) References Cited

U.S. PATENT DOCUMENTS 5,301,923 A 4/1994 Asao et al.
5,641,730 A 6/1997 Brown
(Continued)

FOREIGN PATENT DOCUMENTS

CN 1424388 A 6/2003
CN 1926224 A 3/2007
(Continued)

OTHER PUBLICATIONS

International Search Report (PCT/ISA/210) dated Oct. 28, 2014, by the Japanese Patent Office as the International Searching Authority for International Application No. PCT/JP2014/070467.
(Continued)

*Primary Examiner* — Vishal Vasisth
(74) *Attorney, Agent, or Firm* — Buchanan, Ingersoll & Rooney PC

(57) ABSTRACT

The invention provides a grease composition containing a base oil, a thickener, and an anti-flaking additive such as a compound represented by, for example, formula (1-1), which grease composition can prevent the white layer flak-
(Continued)

ing of the rolling bearings. (In the formula, R1 and R4 are each independently a straight-chain or branched alkyl or alkenyl group having 1 to 20 carbon atoms.)

(1-1)

5 Claims, 1 Drawing Sheet

(51) Int. Cl.

| | |
|---|---|
| ***C10M 173/02*** | (2006.01) |
| ***C10M 115/08*** | (2006.01) |
| ***C10M 101/02*** | (2006.01) |
| ***C10M 105/04*** | (2006.01) |
| ***C10M 105/18*** | (2006.01) |
| ***C10M 105/42*** | (2006.01) |
| ***C10M 135/04*** | (2006.01) |
| ***C10M 135/06*** | (2006.01) |
| ***C10M 169/00*** | (2006.01) |

(52) U.S. Cl.
CPC ..... *C10M 105/18* (2013.01); *C10M 105/42* (2013.01); *C10M 115/08* (2013.01); *C10M 135/04* (2013.01); *C10M 135/06* (2013.01); *C10M 169/00* (2013.01); *C10M 2215/1026* (2013.01); *C10M 2219/022* (2013.01); *C10M 2219/024* (2013.01); *C10M 2219/082* (2013.01); *C10M 2219/086* (2013.01); *C10M 2219/102* (2013.01); *C10M 2219/106* (2013.01); *C10N 2230/06* (2013.01); *C10N 2240/02* (2013.01); *C10N 2250/10* (2013.01)

(58) Field of Classification Search
USPC ..... 508/271, 388, 552
See application file for complete search history.

(56) References Cited

U.S. PATENT DOCUMENTS

| | | | |
|---|---|---|---|
| 6,652,149 | B2 | 11/2003 | Hokao et al. |
| 7,256,163 | B2 | 8/2007 | Akada et al. |
| 7,265,080 | B2 | 9/2007 | Iso et al. |
| 7,932,219 | B2 | 4/2011 | Miakmi |
| 8,703,678 | B2 | 4/2014 | Fujinami et al. |
| 9,012,386 | B2 | 4/2015 | Saita et al. |
| 9,528,073 | B2 | 12/2016 | Endo et al. |
| 2002/0159662 | A1 | 10/2002 | Hokao et al. |
| 2003/0139302 | A1 | 7/2003 | Akada et al. |
| 2005/0261141 | A1 | 11/2005 | Iso et al. |
| 2006/0252654 | A1 | 11/2006 | Iso et al. |
| 2006/0252655 | A1 | 11/2006 | Iso et al. |
| 2007/0184990 | A1 | 8/2007 | Mikami |
| 2010/0035779 | A1 | 2/2010 | Fujinami et al. |
| 2010/0298178 | A1 | 11/2010 | Endo et al. |
| 2012/0314985 | A1 | 12/2012 | Saita et al. |
| 2015/0133353 | A1 | 5/2015 | Arai et al. |

FOREIGN PATENT DOCUMENTS

| | | | |
|---|---|---|---|
| CN | 101910386 | A | 12/2010 |
| CN | 102770514 | A | 11/2012 |
| EP | 1314774 | A1 | 5/2003 |
| EP | 2540813 | A1 | 1/2013 |
| EP | 2857481 | A1 | 4/2015 |
| JP | H 3-210394 | A | 9/1991 |
| JP | H 3-250094 | A | 11/1991 |
| JP | H 5-263091 | A | 10/1993 |
| JP | H 9-176670 | A | 7/1997 |
| JP | 2001-247888 | A | 9/2001 |
| JP | 2002-130301 | A | 5/2002 |
| JP | 2002-206095 | A | 7/2002 |
| JP | 2002-250351 | A | 9/2002 |
| JP | 2003-013083 | A | 1/2003 |
| JP | 2003-082374 | A | 3/2003 |
| JP | 2004-108403 | A | 4/2004 |
| JP | 2004-162849 | A | 6/2004 |
| JP | 2004-196997 | A | 7/2004 |
| JP | 2004-225843 | A | 8/2004 |
| JP | 2005-008825 | A | 1/2005 |
| JP | 2006-077967 | A | 3/2006 |
| JP | 2006-292039 | A | 10/2006 |
| JP | 2007-186609 | A | 7/2007 |
| JP | 2007-192329 | A | 8/2007 |
| JP | 2009-114354 | A | 5/2009 |
| WO | WO 2005/085400 | A1 | 9/2005 |
| WO | WO 2008/044650 | A1 | 4/2008 |
| WO | WO 2009/093685 | A1 | 7/2009 |
| WO | WO 2009/110452 | A1 | 9/2009 |
| WO | WO 2011/059097 | A1 | 5/2011 |
| WO | WO 2011/155513 | A1 | 12/2011 |

OTHER PUBLICATIONS

Written Opinion (PCT/ISA/237) dated Oct. 28, 2014, by the Japanese Patent Office as the International Searching Authority for International Application No. PCT/JP2014/070467.

Extended Search Report issued by the European Patent Office in corresponding European Patent Application No. 14832412.2 dated Jan. 30, 2017 (8 pages).

Office Action issued by the State Intellectual Property Office of People's Republic of China in corresponding Chinese Patent Application No. 201480043381.X dated Feb. 28, 2017 (16 pages including partial English translation).

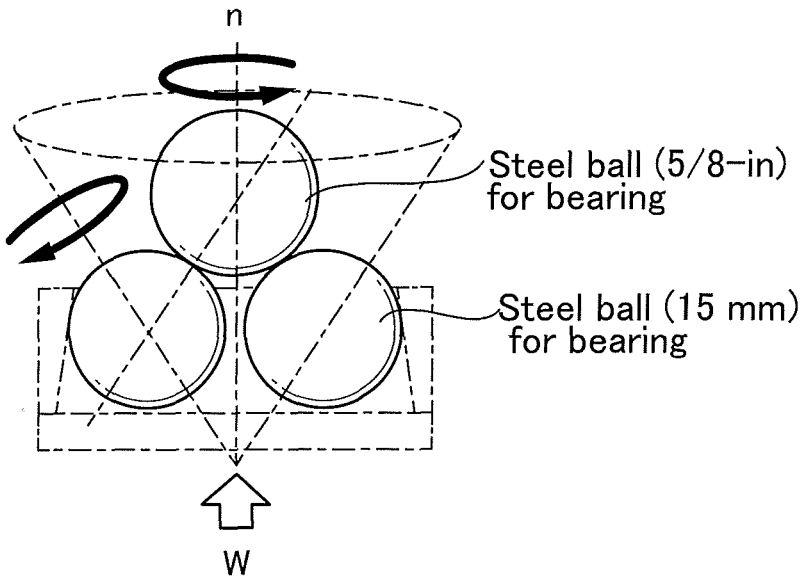
n
Steel ball (5/8-in)
for bearing
Steel ball (15 mm)
for bearing
W

GREASE COMPOSITION

This application is a 371 of PCT/JP2014/070467, filed Aug. 4, 2014.

TECHNICAL FIELD

The present invention relates to a grease composition for preventing white layer flaking of the rolling bearings.

BACKGROUND ART

To satisfy the demands on cars for a smaller size and lighter weight on one hand and a larger living space on the other hand, the reduction of space for the engine room has been required, which has led to the reduction in size and weight of the parts in the automotive electrical equipment and automotive auxiliaries, such as alternators, tension pulleys and the like. Also, in response to the demand for quietness, the engine room is closely sealed, so that greases are required to be resistant to high temperatures in consideration of the high-temperature operating environments.

In addition, the poly-V belts have been employed since the mid-1980s to meet the tendencies toward smaller-diameter pulleys and larger transmission torque, and to improve the belt durability. Concurrently, a peculiar problem has been produced, resulting from the flaking that occurs at the early stage, associated with white structural change on the rolling surface of the rolling bearings.

The bearings for use in the automotive electrical equipment or automotive auxiliaries have been thus required to have both long lubrication life and excellent resistance to flaking.

There are conventionally employed for rolling bearings lithium soap greases or diurea greases using inexpensive mineral oil as the base oil; lithium soap greases or diurea greases using as the base oil a synthetic hydrocarbon oil and an ether type synthetic oil and the like. In particular, diurea greases containing the aromatic urea compounds are frequently chosen in light of the durability under high temperatures.

However, those greases cannot satisfy the long bearing life under high temperatures because of the insufficient heat resistance of the employed base oils or thickeners and the poor flowability toward the bearing portions to be lubricated with grease.

In order to inhibit a catalytic action on the metal surface newly exposed as a result of the wear, an anti-flaking additive, for example, an oxidizer for passivation such as nitrites or the like is added to the grease composition for oxidizing the metal surface to inhibit the catalytic action thereof, thereby preventing the generation of hydrogen that would be caused by decomposition of the lubricant. (JP (Hei) 3-210394 A and JP (Hei) 5-263091).

Also, use of a phenyl ether type synthetic oil as the base oil for grease is proposed to prevent the generation of hydrogen caused by decomposition of the lubricant (JP (Hei) 3-250094 A).

Further, it is proposed to add an azo compound capable of absorbing hydrogen to the composition of grease to be used for the metal materials required to have tribological properties and for a variety of members, in particular, the grease to be enclosed in the bearing located at portions easily exposed to water (JP 2002-130301 A).

In addition, a grease composition comprising a fluorinated polymer oil as the base oil, polytetrafluoroethylene as the thickener, and an electroconductive material is proposed for the purpose of extending the life of rolling bearings, without causing the hydrogen embrittlement-induced flaking even when water permeates through the bearing (JP 2002-250351 A).

Also, there is proposed a grease composition comprising a poly α-olefin synthetic oil or diphenyl ether type synthetic oil, a urea-based thickener, at least one of an organic antimony compound or an organic molybdenum compound as the extreme-pressure agent, and zinc sulfonate (JP 2004-108403 A), which is designed to form a film on the surface of the rolling bearing to reduce the load applied to the rolling bearing in the tangential direction thereof under severe conditions including high temperatures, high speeds, heavy loads and the like.

However, any of the above-mentioned proposals do not provide sufficient measures against the flaking problem after generation of hydrogen because those proposals are not intended to cope with the action after generation of hydrogen, in other words, not intended to prevent hydrogen from penetrating to the inside of metal.

As the additives for grease, the compounds containing sulfur atom and nitrogen atom, such as thiadiazole compounds are known. For example, JP (Hei) 09-176670A discloses that a thiazole compound such as 2,5-dimercapto-1,3,4-thiadiazole and the like can impart a wear-resistant action when used in combination with an alkali metal borate.

JP 2002-206095 A discloses that when the grease to be enclosed in the rolling bearing for supporting the main shaft of machine tools comprises a predetermined sulfur-containing compound such as a disulfide compound or the like, the bearing life can be improved and heat generation can be reduced under the high-speed rotations.

JP 2007-186609 A discloses a grease composition for electric contact. When used within a low temperature region, the grease composition is capable of effectively reducing wear of the copper surface or copper alloy surface (silver-plated surface, gold-plated surface) without causing any chattering (drop in voltage) even at the contact of a very low current by adding an organic zinc compound or thiadiazole compound to the grease composition.

SUMMARY OF INVENTION

Technical Problem

An object of the invention is to provide a grease composition capable of preventing the white layer flaking of rolling bearings.

Solution to Problem

As a result of intensive studies by the inventors of the invention, it was found that use of a particular additive can effectively reduce the white layer flaking of rolling bearings so that the additive can successfully extend the anti-flaking life of rolling bearings.

Namely, the invention provides a grease composition as shown below.

A grease composition for preventing the white layer flaking of rolling bearings, comprising a base oil, a thickener, and an anti-flaking additive represented by the following formula (1):

$$R_1—S_x\text{-}A \quad (1)$$

wherein $R_1$ is a hydrogen atom, a straight-chain or branched alkyl or alkenyl group having 1 to 20 carbon atoms, or an aromatic hydrocarbon group having 6 to 26 carbon atoms;

A is a hydrogen atom, $—S_y—R_2$, $—S_y—B—R_3$, $—R_2SH$ or a group represented by the following formula (2-1) or (2-2):

(2-1)

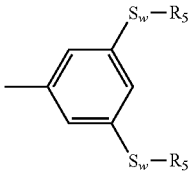

or (2-2)

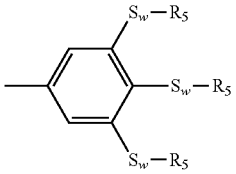

wherein $R_2$ is a straight-chain or branched alkyl or alkenyl group having 1 to 20 carbon atoms, or an aromatic hydrocarbon group having 6 to 26 carbon atoms;

$R_5$ is a straight-chain or branched alkyl or alkenyl group having 1 to 20 carbon atoms, or an aromatic hydrocarbon group having 6 to 26 carbon atoms;

B is a 5-membered heterocyclic ring having at least one heteroatom selected from the group consisting of sulfur atom, nitrogen atom and oxygen atom;

$R_3$ is a hydrogen atom, $—S_z—R_4$, —SH, a straight-chain or branched alkyl or alkenyl group having 1 to 20 carbon atoms, or an aromatic hydrocarbon group having 6 to 26 carbon atoms;

$R_4$ is a straight-chain or branched alkyl or alkenyl group having 1 to 20 carbon atoms, or an aromatic hydrocarbon group having 6 to 26 carbon atoms;

x is a number from 1 to 10;

y is a number from 0 to 10;

z is a number from 1 to 10; and w is a number from 1 to 10;

where the straight-chain or branched alkyl or alkenyl group having 1 to 20 carbon atoms may optionally comprise one or more heteroatoms selected from the group consisting of nitrogen atom and oxygen atom, and/or may be optionally substituted by one or more aromatic hydrocarbon groups having 6 to 26 carbon atoms; provided that $R_1$ and A do not represent a hydrogen atom at the same time.

Advantageous Effects of Invention

The grease composition of the invention can effectively prevent the white layer flaking of rolling bearings to extend the anti-flaking life of the rolling bearings. Also, the grease composition of the invention can exhibit a long lubrication life even at an elevated temperature.

BRIEF DESCRIPTION OF DRAWING

FIG. 1 is a schematic diagram showing the test using four rolling steel balls. In the FIGURE, n indicates 1500 rpm and W indicates 100 kg (4.1 GPa).

DESCRIPTION OF EMBODIMENTS

The term "white layer flaking" herein used means abnormal flaking occurring at the early stage, associated with white color change in the structure. The term "white layer flaking" herein used is synonymous with the terms of white flaking, white phase flaking, embrittlement-induced flaking, hydrogen embrittlement-induced flaking and the like in this field.

In general, the bearing life depending on the rolling fatigue can be estimated in accordance with the formula for the life as defined in the standards (ISO0281, JIS B-1518). However, in the case where the white layer flaking occurs, the life span may become shorter than estimated. In fact, it is reported that the life span of the rolling bearings on the market was as short as about 1/10 to 1/20 the estimated life span. The white layer flaking is one of the damages caused by interior-originating fatigue, and shows a peculiar phenomenon where white layer was exposed when Nital was used to etch the metallic structure after occurrence of the flaking.

[Base Oil]

The base oil that can be used in the invention is not particularly limited. Mineral oils and synthetic oils can be used. Those base oils may be used alone or in combination.

Examples of the synthetic oils include ester type synthetic oils such as diesters and polyol esters; hydrocarbon synthetic oils such as poly α-olefins and polybutene; ether type synthetic oils such as alkyl diphenyl ethers, dialkyl diphenyl ethers and polypropylene glycols; silicone oils; fluorinated oils; and other kinds of synthetic oils.

As for the ester type synthetic oils, complex ester oils are preferred, which are synthesized from a polyol (for example, pentaerythritol) with a monovalent fatty acid (for example, a straight-chain or branched saturated or unsaturated fatty acid having 6 to 22 carbon atoms, such as caprylic acid, nonanoic acid or the like) and a polybasic acid (for example, a straight-chain or branched saturated or unsaturated dibasic acid having 3 to 10 carbon atoms, such as adipic acid or the like). In particular, it is preferable to use complex ester oils synthesized from pentaerythritol with adipic acid, heptanoic acid, caprylic acid and capric acid.

Of the hydrocarbon synthetic oils, poly α-olefins are preferable.

Of the ether type synthetic oils, alkyl diphenyl ethers are preferable.

The synthetic oils are preferably used as the base oils in the invention. Particularly, the ester type synthetic oils, hydrocarbon synthetic oils and ether type synthetic oils are preferable. The complex ester oils synthesized from pentaerythritol with fatty acids consisting of adipic acid, heptanoic acid, caprylic acid and capric acid; poly α-olefins; and alkyl diphenyl ethers are more preferable.

The base oil may preferably have a kinematic viscosity at 40° C. of 20 to 500 $mm^2/s$. When the kinematic viscosity is less than 20 $mm^2/s$ at 40° C., a sufficient oil film may not be ensured during the low speed operation and under high temperatures. When the kinematic viscosity exceeds 500 $mm^2/s$ at 40° C., the torque may abnormally increase during the high speed operation and under low temperatures. From the same reasons as mentioned above, the kinematic viscosity at 40° C. may be more preferably 50 to 200 $mm^2/s$, and most preferably 60 to 130 $mm^2/s$.

The content of the base oil may preferably be in the range of 95 to 50 mass %, and more preferably 90 to 70 mass %, based on the total mass of the grease composition of the invention.

[Thickener]

Under the circumstances of high temperatures, the flowability of the grease in the bearing varies depending on the kind of thickener contained in the grease, which has a serious effect on the bearing lubrication life. For obtaining the long lubrication life, the grease is required to constantly retain on the portions to be lubricated, without softening or leakage. In light of this, as the thickener that can be used in the invention, a diurea compound represented by the following formula (I) is preferable:

R1-NHCONH—R2-NHCONH—R3 (I)

wherein R2 is a bivalent aromatic hydrocarbon group having 6 to 15 carbon atoms; and R1 and R3, which may be the same or different from each other represent a straight-chain or branched alkyl group having 8 to 22 carbon atoms, cyclohexyl group or an aromatic hydrocarbon group having 6 to 12 carbon atoms.

The diurea compound of formula (I) is obtainable by reacting a diisocyanate represented by the following formula (II) with a monoamine represented by the following formula (III-1) or (III-2). The reaction conditions for obtaining the diurea compound are well known to persons skilled in the art.

O=C=N—R2-N=C=O (II)

R1-$NH_2$ (III-1)

R3-$NH_2$ (III-2)

(wherein R1, R2 and R3 are the same as those previously defined.)

Representative examples of the group indicated by $R^2$ include the groups having the following structural formulas. Particularly preferable is the group where two phenyl groups are bonded to methylene group, as indicated by (II-2) in the center.

(II-1)

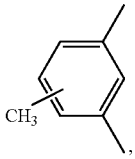

(II-2)

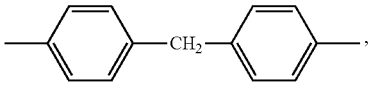

(II-3)

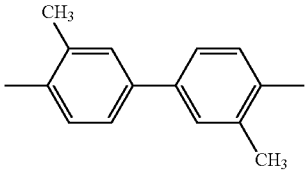

As the alkyl group having 8 to 22 carbon atoms, straight-chain alkyl groups having 8 to 18 carbon atoms are preferred, and straight-chain alkyl groups having 8 carbon atoms and 18 carbon atoms are most preferable. As the aromatic hydrocarbon group having 6 to 12 carbon atoms, those having seven carbon atoms are most preferable.

When one of $R^1$ or $R^3$ represents cyclohexyl group and the other represents a straight-chain or branched alkyl group having 8 to 22 carbon atoms in formula (I), the ratio of the number of moles of the cyclohexyl groups to the total number of moles of the cyclohexyl groups and the straight-chain or branched alkyl groups having 8 to 22 carbon atoms may be in the range of 60 to 95%, and more preferably 70 to 90%. If the above-mentioned molar ratio is less than 60%, the flowability tends to increase and the resultant grease tends to soften, so that the grease easily leaks from the bearing, which will shorten the life. If the above-mentioned molar ratio exceeds 95%, the resultant grease tends to be so hard that the flowability becomes poor. As a result, the grease cannot easily penetrate into the portion to be lubricated, which may shorten the life.

Particularly, the diurea compound obtainable by reacting the diisocyanate of formula (II) where R2 is the group represented by the above formula (II-2) with the monoamine of formula (III-1) where R1 is a straight-chain alkyl group having eight carbon atoms and the monoamine of formula (III-2) where R3 is a straight-chain alkyl group having eight carbon atoms, that is, the diurea compound represented by the following formula (I-1) is preferably used.

(I-1)

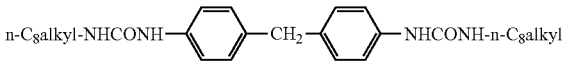

Also, preferred is a mixture of the diurea compound obtainable by reacting the diisocyanate of formula (II) where R2 is the group represented by the above formula (II-2) with the monoamine of formula (III-1) where R1 is cyclohexyl group and the monoamine of formula (III-2) where R3 is a straight-chain alkyl group having 18 carbon atoms, that is, the diurea compound represented by the following formula (I-2-1); the diurea compound represented by the following formula (I-2-2); and the diurea compound represented by the following formula (I-2-3), with the ratio of the number of moles of the cyclohexyl groups to the total number of moles of the cyclohexyl groups and the straight-chain alkyl groups having 18 carbon atoms being in the range of 70 to 90 mol %.

(I-2-1)

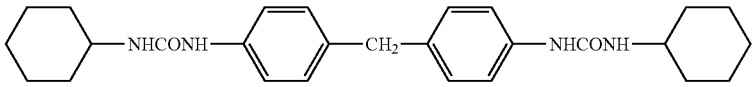

(I-2-2)

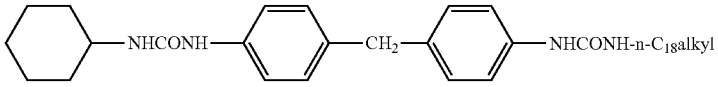

-continued

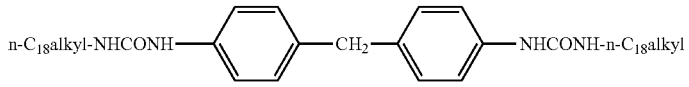

(I-2-3)

Also, the diurea compound obtainable by reacting the diisocyanate of formula (II) where R2 is the group represented by the above formula (II-2) with the monoamine of formula (III-1) where R1 is an aromatic hydrocarbon group having seven carbon atoms and the monoamine of formula (III-2) where R3 is an aromatic hydrocarbon group having seven carbon atoms, that is, the diurea compound represented by the following formula (I-3) is particularly preferable.

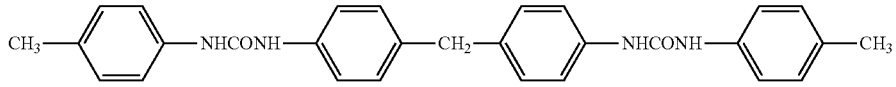

(I-3)

Most preferable is a mixture of the diurea compounds represented by the above formulas (I-2-1), (I-2-2) and (I-2-3), with the ratio of the number of moles of the cyclohexyl groups to the total number of moles of the cyclohexyl groups and the straight-chain alkyl groups having 18 carbon atoms being in the range of 70 to 90 mol %.

The content of the thickener may preferably be in the range of 5 to 25 mass %, and more preferably 10 to 20 mass %, based on the total mass of the grease composition according to the invention. With the content of less than 5 mass %, the resultant grease will be soft and may cause the problem of leakage, which cannot satisfy the lubrication life. On the other hand, when the content exceeds 25 mass %, the poor flowability will hinder the grease from entering into the portions to be lubricated, which may make the lubrication life unsatisfactory.

[Worked Penetration]

The worked penetration of the grease composition according to the invention may preferably be 200 to 300, and more preferably 220 to 280. When the worked penetration exceeds 300, the high-speed revolutions will often cause the problem of grease leakage, which may hinder the satisfactory lubrication life. When the worked penetration is less than 200, the poor flowability of the resultant grease may not satisfy the required lubrication life.

[Anti-Flaking Additive]

The anti-flaking additive used in the invention is represented by the above formula (1). The anti-flaking additive may be used alone or two or more kinds of anti-flaking additives may be used together.

The anti-flaking additive that is used in the invention includes the following compounds:

S—H compounds represented by formula (1) where $R_1$ is a hydrogen atom;

di-, tri-, tetra- or polysulfide bond-containing compounds represented by formula (1) where $R_1$ is a straight-chain or branched alkyl or alkenyl group having 1 to 20 carbon atoms or an aromatic hydrocarbon group having 6 to 26 carbon atoms; and A is $—S_y—R_2$ or $—S_y—B—R_3$; and thiazole compounds represented by formula (1) where A is $—S_y—B—R_3$, in which $R_3$ represents $—S_z—R_4$, —SH, a straight-chain or branched alkyl or alkenyl group having 1 to 20 carbon atoms or an aromatic hydrocarbon group having 6 to 26 carbon atoms.

Specific examples of the anti-flaking additive represented by formula (1) include mercaptan, mercaptothiazole and derivatives thereof, mercaptothiadiazole and derivatives thereof, dimercaptothiadiazole and derivatives thereof, sulfurized fats and oils, olefin sulfides, polysulfides, mercaptothiazole benzothiazole, benzothiadiazole and the like.

More specifically, examples are as follows: diphenyl sulfide, benzylphenyl sulfide, diphenyl disulfide, 4,4'-dimethyldiphenyl disulfide, 2,2'-dipyridyl disulfide, 2,2-dipyrimidine disulfide, bis(benzothiazole-2-yl)persulfide, difurfuryl disulfide, dimethyl sulfide, diethyl sulfide, isopropyl sulfide, n-propyl sulfide, isobutyl sulfide, di-n-hexyl sulfide, dodecylmethyl sulfide, n-nonyl sulfide, n-dodecyl sulfide, di-n-butyl disulfide, methylpropyl trisulfide, bis-(2-mercaptoethyl)sulfide, dibutyl trisulfide, didodecyl trisulfide, dioctyl pentasulfide, didodecyl pentasulfide, dinonyl pentasulfide, dodecyl disulfide, dodecyl trisulfide, dioctyl pentasulfide, dioctyl tetrasulfide, o-mercaptobenzoic acid, 2-(methylmercapto)aniline, 6-mercaptonicotinic acid, 2-mercaptopyrimidine, (2-mercaptoethyl)pyrazine, 4,6-dimethyl-2-mercaptopyrimidine, 4-hydroxy-2-mercapto-6-phenylpyrimidine, 6-mercaptopurine, 3-mercapto-1,2,4-azole, 2-dibutylamino-4,6-dimercapto-s-triazine, 1-ethyl-5-mercaptotetrazole, 1-methyl-5-mercaptotetrazole, 1-(m-acetamidophenyl)-5-mercaptotetrazole, 1-(4-ethoxyphenyl)-5-mercaptotetrazole, 1-cyclohexyl-5-mercaptotetrazole, 4-methyl-2-mercaptobenzo-thiazole, 4,5-dimethylthiazole, 2-isopropyl-4-methylthiazole, 1,2-benzisothiazole, 2-methyl-β-naphthothiazole, 2-methoxythiazole, thiazole-2-carbaldehyde, 2-acetyl thiazole, benzothiazole-2-acetonitrile, 4-thiazolamine, 2-amino-4-methylthiazole, benzothiazol-6-amine, 5-aminobenzothiazole, 2-aminobenzothiazole, 2-amino-6-methylbenzothiazole, 4-(2-methyl-4-thiazolyl)aniline, 2-amino-5-phenylthiazole, 2-amino-6-methoxybenzothiazole, 5-methoxybenzothiazol-2-amine, 2-aminobenzo-thiazol-6-ol, 2-amino-α-(methoxyimino)-4-thiazoleacetic acid ethyl ester, 3-isothiazolecarboxylic acid, 4-thiazolecarboxylic acid, 3-methyl-4-isothiazole-carboxylic acid, 4-methyl-5-thiazolecarboxylic acid, 2-methylthiazole-5-carboxylic acid, benzothiazole-2-carboxylic acid, 2-benzothiazole acetic acid, 4-methyl-5-thiazole ethanol, 2-mercaptobenzothiazole, 4-methyl-2-mercaptobenzothiazole, bis(benzothiazol-2-yl)persulfide, 2,5-dimercapto-1,3,4-thiadiazole, 2,5-dithioacetic acid-1,3,4-thiadiazole, 2-amino-1,3,4-thiadiazole, 2-thioacetic acid-5-mercapto-1,3,4-thiadiazole, benzenethiol, phenylmethanethiol, p-toluenethiol, 3-methylbenzenethiol, 3,4-dimethylbenzenethiol, 2-naphthalenethiol, p-xylenedithiol, toluene-3,4-dithiol, 2-aminobenzenethiol, 2-methoxybenzenethiol, 3H-1,2-benzodithiol-3-one, 3H-1,2-benzodithiol-3-one 1,1-dioxide, 3-pyridinethiol, 2-pyridinethiol, 6-methyl-2-pyridinethiol, 5-nitro-2-pyridinethiol, 1H-imidazole-2-thiol, 5-nitro-1H-benzoimidazole-2-thiol, 5-methoxy-1H-benzimidazole-2-thiol, 1,1'-(thiocarbonyl)-bis(1H-imidazole), 6-(dibutylamino)-1,3,5-triazine-2,4-dithiol, 1-phenyl-1H-tetrazole-5-thiol, 1,3-dithiol-2-thione, ethylenetrithiocarbonate, 1,3-dithiol-2-thione-4,5-dicarboxylic acid dimethyl ether, 4-methyl-2-mercaptobenzothiazole, 5-amino-1,3,4-thiadiazole-2-thiol, bismuthiol, 2,2'-dithiobis(1,3,4-thiadiazole-5-thiol), bis[(diethoxyphosphinothioyl)thio]methane, 5-heptyl-1,3,4-oxadiazole-2-thiol, methanethiol, 1-propanethiol, n-amyl mercaptan, n-hexyl mercaptan, n-hexadecyl mercaptan, stearyl mercaptan, 1,3-propanedithiol, 1,4-butanedithiol, 1,5-pentanedithiol, 1,6-hexanedithiol, isobutyl mercaptan, 2,3-butanedithiol, 1,2-propanedithiol, β-mercaptopropionic acid, triglycol dimercaptan, mercaptopropionic acid methoxybutyl ether, 2-ethylhexyl-3-mercaptopropionate, n-octyl-3-mercaptopropionate, mercapto-propionic acid tridecyl ether, stearyl-3-mercaptopropionate, 3-mercaptopropionate, bis-(2-mercaptoethyl)sulfide, trimethylol propane, tris(3-mercaptopropionate), dodecyldithiobenzothiazole, hexyldithiobenzothiazole, dodecyldithiobenzimidazole, 2,5-bis(dodecyldithio)thiadiazole, 2,5-bis(octyldithio)thiadiazole, 2,5-bis(diethyldithio-carbamic acid)thiadiazole, sulfurized fats and oils, olefin sulfides and the like.

In particular, preferably used is a compound of formula (1) wherein $R_1$ is a straight-chain or branched alkyl or alkenyl group having 1 to 20 carbon atoms, A is a group represented by $—S_y—B—R_3$, in which B is a group as shown below:

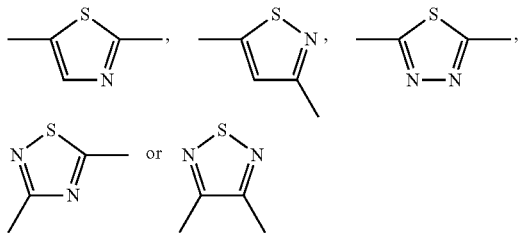

$R_3$ represents $—S_z—R_4$, in which $R_4$ is a straight-chain or branched alkyl or alkenyl group having 1 to 20 carbon atoms, x is 2, y is 0, and z is 2.

Also, the sulfurized fats and oils, and olefin sulfides are preferable.

Especially, 2,5-dimercapto-1,3,4-thiazole derivatives represented by the following formula (1-1) are preferred.

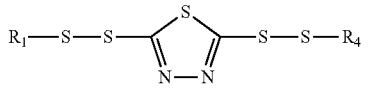

(1-1)

Of the compounds of formula (1-1), the compound where R1 and R4 are each a straight-chain or branched alkyl or alkenyl group having 1 to 20 carbon atoms is preferable. It is most preferable when R1 and R4 both represent a straight-chain alkyl group having eight carbon atoms.

Without wishing to be bound by any theory, the mechanism which can effectively prevent the white layer flaking of the rolling bearings by using the grease composition of the invention comprising the anti-flaking additive represented by formula (1) is considered to be as follows.

Namely, there are various opinions about the mechanism which causes the white layer flaking, and the cause has not yet been identified. However, according to the one opinion, the cause for the white layer flaking is presumed to be the presence of hydrogen. More specifically, when the grease is used under a heavy load, the grease will decompose to generate hydrogen. The hydrogen thus generated will penetrate to the inside of the steel material of the rolling bearing and then react with carbide at the grain boundaries. This is considered to result in embrittlement of the steel material.

The anti-flaking additive used in the invention has in the molecular structure thereof at least one sulfur atom, which is readily adsorbed on the metal surface of the rolling bearing. Through the generation of iron-mercaptide, a film of iron sulfide is obtained on the surface. The thus obtained iron sulfide film can prevent hydrogen from penetrating to the inside of the metal, which is considered to lead to excellent anti-flaking properties.

The content of the anti-flaking additive may preferably be in the range of 0.1 to 20 mass %, more preferably 0.5 to 10 mass %, and most preferably 0.5 to 4 mass %, based on the total mass of the grease composition. With the content of less than 0.1 mass %, a sufficient effect cannot be expected. When the content exceeds 20 mass %, the cost performance is disadvantageous because the obtainable effect will be saturated.

[Optional Additives]

The grease composition of the invention may further comprise any other generally used additives when necessary. For example, the rust inhibitor, load carrying additive, antioxidant and the like may be added if necessary. The contents of those optional additives may generally be 0.5 to 5 mass % based on the total mass of the grease composition according to the invention.

The rust inhibitor includes inorganic and organic ones. Examples of the inorganic rust inhibitor include inorganic metallic salts such as sodium silicate, lithium carbonate, potassium carbonate, zinc oxide and the like. Examples of the organic rust inhibitor include benzoates such as sodium benzoate and lithium benzoate, sulfonates such as calcium sulfonate and zinc sulfonate, carboxylates such as zinc naphthenate and sodium sebacate, succinic acid and derivatives thereof such as succinic anhydride and succinic acid half ester, sorbitan esters such as sorbitan monooleate and sorbitan trioleate, and fatty acid amine salts.

Examples of the load carrying additive include phosphorus-containing compounds such as phosphate and the like; sulfur-containing compounds such as polysulfides, sulfurized fats and oils, and the like; phosphorus-sulfur compounds such as phosphorothionates and the like; thiocarbamates; thiophosphates; and organic phosphates.

The antioxidant is known as an oxidative degradation inhibitor for grease. The phenol type antioxidants and the amine type antioxidants can be used.

Examples of the phenol type antioxidants include 2,6-di-t-butyl-p-cresol (BHT), 2,2'-methylenebis(4-methyl-6-t-butylphenol), 4,4'-butylidenebis(3-methyl-6-t-butyl-phenol), 2,6-di-t-butylphenol, 2,4-dimethyl-6-t-butylphenol, t-butylhydroxy anisole (BHA), 4,4'-butylidenebis(3-methyl-6-t-butylphenol), 4,4'-methylenebis(2,3-di-t-butylphenol), 4,4'- thiobis(3-methyl-6-t-butylphenol), octadecyl-3-(3,5-di-t-butyl-4-hydroxyphenyl)propionate and the like. In particular, octadecyl-3-(3,5-di-t-butyl-4-hydroxyphenyl) propionate is preferably used.

Examples of the amine type antioxidants include N-n-butyl-p-aminophenol, 4,4'-tetramethyl-di-aminodiphenylmethane, α-naphthylamine, N-phenyl-α-naphthylamine, phenothiazine, alkyldiphenylamine and the like. In particular, alkyldiphenylamine is preferably used.

[Bearing]

The grease composition of the invention is used for a variety of rolling bearings in the industrial machines and automobiles. Examples of the rolling bearings for the industrial machines include those for various motors of the industrial machines, the reduction gears and oil hydraulic components of the industrial robots, the main shaft and reduction gears of the wind power generators, and the winches for the elevators. The rolling bearings for the automobiles preferably include those for the automotive electrical equipment or automotive auxiliaries, for example, alternators, electromagnetic clutches for car's air conditioners, intermediate pulleys, idler pulleys, tension pulleys and the like.

Examples

<Sample Grease Compositions>

Preparation of Sample Grease Compositions

Diphenylmethane diisocyanate was reacted with the predetermined amount(s) of amine(s) (octylamine, cyclohexylamine, stearylamine, p-toluidine) in each base oil to prepare a base grease. To the base grease, the base oil and the additives were added to have a worked penetration of 280 (when determined according to JIS K2220) in a mill, thereby obtaining a grease composition.

The formulation for the sample grease compositions are shown in the following Tables. The components used for the preparation of the sample grease compositions are as follows.

<Base Oils>

POE: Complex ester oil synthesized from pentaerythritol with adipic acid, heptanoic acid, caprylic acid and capric acid (Kinematic viscosity at 40° C.: 102 $mm^2/s$)

PAO: Synthetic hydrocarbon oil (Kinematic viscosity at 40° C.: 68.0 $mm^2/s$)

ADE: Alkyldiphenyl ether oil (Kinematic viscosity at 40° C.: 100 $mm^2/s$)

MO: Mineral oil (Kinematic viscosity at 40° C.: 90 $mm^2/s$)

The kinematic viscosity of the base oil was determined in accordance with JIS K 2220 23.

<Thickeners>

Aliphatic diurea: diurea compound consisting of diphenylmethane diisocyanate and octylamine.

Alicyclic—aliphatic diurea: diurea compound consisting of diphenylmethane diisocyanate, and a mixture of cyclohexylamine and stearylamine (with a molar ratio of 5:1).

Aromatic diurea: diurea compound consisting of diphenylmethane diisocyanate and p-toluidine.

<Anti-Flaking Additive>

Bis(octyldithio)thiazole

Olefin sulfide

Sulfurized fat and oil $NaNO_2$ (sodium nitrite)

The term "mass %" in the following Tables means the percentage by mass based on the total mass of each sample grease composition. All the sample grease compositions contained the following antioxidant and rust inhibitor although they are not indicated in the Tables.

<Test Method>

Test using four rolling steel balls (Outline of the Test)

As shown in FIG. 1, three steel balls with a diameter of 15 mm designed for bearings were disposed in a cylindrical container with an inner diameter of 40 mm and a height of 14 mm, which was filled with about 20 g of each test grease composition. Another steel ball (⅝-in) for bearing was set to a tester so that the steel ball (⅝-in) was placed in contact with the top of the three steel balls. The steel ball (⅝-in) was driven to rotate for 4 hours for shakedown with the application of a load in a direction of W as shown in FIG. 1, and then hydrogen gas was introduced into the tester. The lower three balls revolved as each rotating on its axis. The ball was driven to rotate continuously until the flaking took place on the steel ball surfaces.

The flaking occurs at a point between two balls where the highest contact pressure is applied.

The life was expressed as the total number of contact times of the upper ball with the lower balls counted when the flaking took place. These procedures were repeated at least five times to determine the L50 life (i.e., the number of contact times when 50% expired). The results are shown in Tables 1 and 2.

(Test Conditions)

Steel balls for test: 15-mm-dia. steel balls and a ⅝-in steel ball for bearing

Load for test (W): 100 kgf (4.1 GPa)

Rotational speed (n): 1500 rpm

Feed rate of hydrogen gas: 15 ml/min.

Atmospheric pressure at test part: 0.96 atm. (because of vacuum extraction)

The repeated number of tests: 5 (at a minimum)

(Evaluations)

$20\times10^6$ times or more: o (acceptable)

Less than $20\times10^6$ times: x (unacceptable)

TABLE 1

| | | Examples | | | | | | | |
|---|---|---|---|---|---|---|---|---|---|
| | | 1 | 2 | 3 | 4 | 5 | 6 | 7 | 8 |
| Base oils | ADE | Balance | — | — | — | Balance | Balance | Balance | Balance |
| | POE | — | Balance | — | — | — | — | — | — |
| | PAO | — | — | Balance | — | — | — | — | — |
| | MO | — | — | — | Balance | — | — | — | — |
| Thickeners (mass %) | Aliphatic diurea | 10 | 10 | 10 | 10 | — | — | — | — |
| | Alicyclic - aliphatic diurea | — | — | — | — | 10 | — | 10 | 10 |
| | Aromatic diurea | — | — | — | — | — | 19 | — | — |

TABLE 1-continued

| | | Examples | | | | | | | |
|---|---|---|---|---|---|---|---|---|---|
| | | 1 | 2 | 3 | 4 | 5 | 6 | 7 | 8 |
| Anti-flaking additives (mass %) | Bis(octyldithio)-thiazole | 2 | 2 | 2 | 2 | 2 | 2 | — | — |
| | Olefin sulfide | — | — | — | — | — | — | 2 | — |
| | Sulfurized oil fat | — | — | — | — | — | — | — | 2 |
| Test using four rolling steel balls | Number of contacts L50 ($\times 10^6$) | 20< | 20< | 20< | 20< | 20< | 20< | 20< | 20< |
| | Evaluations | ○ | ○ | ○ | ○ | ○ | ○ | ○ | ○ |

TABLE 2

| | | Comparative Examples | | | | | | |
|---|---|---|---|---|---|---|---|---|
| | | 1 | 2 | 3 | 4 | 5 | 6 | 7 |
| Base oils | ADE | Balance | Balance | — | — | — | Balance | Balance |
| | POE | — | — | Balance | — | — | — | — |
| | PAO | — | — | — | Balance | — | — | — |
| | MO | — | — | — | — | Balance | — | — |
| Thickeners (mass %) | Aliphatic diurea | 10 | 10 | 10 | 10 | 10 | — | — |
| | Alicyclic - aliphatic diurea | — | — | — | — | — | 10 | — |
| | Aromatic diurea | — | — | — | — | — | — | 19 |
| Anti-flaking additive (mass %) | $NaNO_2$ | — | 2 | 2 | 2 | 2 | 2 | 2 |
| Test using four rolling steel balls | Number of contacts L50 ($\times 10^6$) | 1.2 | 12.8 | 8.7 | 9.5 | 10.2 | 14.2 | 15.5 |
| | Evaluations | x | x | x | x | x | x | x |

The invention claimed is:

1. A grease composition, comprising a base oil, a thickener, and an anti-flaking additive selected from the group consisting of a compound represented by formula (1-1):

(1-1)

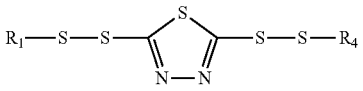

wherein $R_1$ and $R_4$ are each a straight-chain or branched alkyl or alkenyl group having 1 to 20 carbon atoms;

sulfurized oil fat; and olefin sulfide, wherein the base oil is a synthetic oil selected from the group consisting of ester synthetic oils obtained from a polyol, a monovalent fatty acid and a polybasic acid, hydrocarbon synthetic oils, and ether synthetic oils, wherein the thickener is a diurea compound represented by formula (I-1):

(I-1)

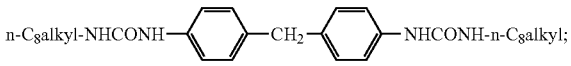

or a mixture of a diurea compound represented by formula (I-2-1), a diurea compound represented by formula (I-2-2) and a diurea compound represented by formula (I-2-3), (I-2-1)

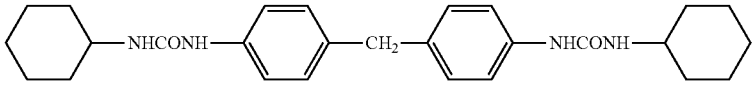

(I-2-2)

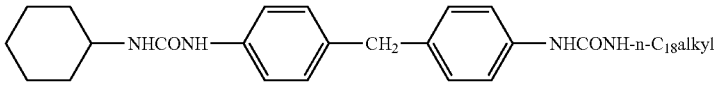

-continued (I-2-3)

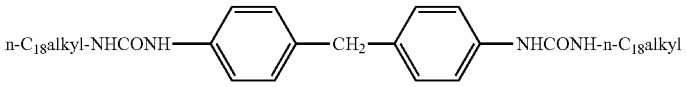

with the ratio of the number of moles of the cyclohexyl groups to the total number of moles of the cyclohexyl groups and the straight-chain alkyl groups having 18 carbon atoms being in the range of 70 to 90 mol %, wherein the base oil is contained in an amount of 90 to 70 mass % based on the total mass of the grease composition, wherein the thickener is contained in an amount of 5 to 20 mass % based on the total mass of the grease composition, and wherein the anti-flaking additive is contained in an amount of 0.5 to 10 mass % based on the total mass of the grease composition.

2. The grease composition of claim 1, wherein the anti-flaking additive is the 2,5-dimercapto-1,3,4-thiazole derivative of formula (1-1) wherein R1 and R4 are both straight-chain alkyl groups having eight carbon atoms; the sulfurized oil fat; or the olefin sulfide.

3. The grease composition of claim 1, wherein the base oil has a kinematic viscosity at 40° C. of 20 to 500 $mm^2/s$.

4. The grease composition of claim 1, wherein the base oil has a kinematic viscosity at 40° C. of 50 to 500 $mm^2/s$.

5. The grease composition of claim 1, wherein the base oil is selected from the group consisting of poly α-olefins; alkyl diphenyl ether; and ester synthetic oil obtained from pentaerythritol, adipic acid, heptanoic acid, caprylic acid and capric acid.

* * * * *